United States Patent [19]

Schauls

[11] 3,983,191

[45] Sept. 28, 1976

[54] BRAZED PLATE-TYPE HEAT EXCHANGER FOR NONADIABATIC RECTIFICATION

[75] Inventor: James J. Schauls, La Crosse, Wis.

[73] Assignee: The Trane Company, La Crosse, Wis.

[22] Filed: Nov. 10, 1975

[21] Appl. No.: 630,284

[52] U.S. Cl. ..... 261/114 R; 202/158; 165/166

[51] Int. Cl.[2] ..... B01F 3/04

[58] Field of Search..... 202/158; 261/112, 114 R, 261/114 A; 165/166

[56] References Cited

UNITED STATES PATENTS

| | | | |
|---|---|---|---|
| 2,523,126 | 9/1950 | Long | 261/114 A |
| 2,877,099 | 3/1959 | Bowles | 261/114 R |
| 3,282,334 | 11/1966 | Stahlheber | 165/166 |
| 3,310,105 | 3/1961 | Butt | 165/166 |
| 3,712,595 | 1/1973 | Hirsch | 261/114 R |

*Primary Examiner*—Charles J. Myhre
*Assistant Examiner*—Theophil W. Streule, Jr.

[57] ABSTRACT

A plate-type heat exchanger is shown wherein certain of the passageways thereof have been specially modified to include a downcomer to provide improved reflux nonadiabatic rectification capabilities.

12 Claims, 9 Drawing Figures

BRAZED PLATE-TYPE HEAT EXCHANGER FOR NONADIABATIC RECTIFICATION

BACKGROUND OF THE INVENTION

This invention pertains to the art of plate-type heat exchangers which comprise a stack of parallel plates spaced to provide passageways therebetween. Heat is transferred from the fluids passing in one set of passageways to the fluids passing in another set of passageways via heat conduction through the interposed plates. More particularly this invention relates to plate-type heat exchangers in which the passageways are provided with sections of corrugated fin material or packing. Such heat exchangers have been employed for rectification purposes. Gas or vapor is caused to flow upward through one passageway in countercurrent flow relationship to a liquid. Heat is transferred to or from this liquid and vapor by another passageway for nonadiabatic rectification. The corrugated fin packing improves the heat transfer and permits extensive vapor-liquid contact for mass transfer. Ideally, the composition of the fluids in the one passageway will progressively change from one end of the heat exchanger passageway to the other as a result of the constituent concentration differentials between the contacting liquid and vapor and heat transfer acting over a period of time. An example of a plate-type heat exchanger intended for use in this manner may be found in U.S. Pat. No. 2,703,700.

Plate-type heat exchangers with corrugated fin packing used for nonadiabatic rectification have followed at least two designs. As used herein, "corrugated fin packing" means a packing formed by corrugating a porous or nonporous metallic sheet.

In the first type of heat exchanger the principal corrugated fin packing for the two-phase flow passageway is arranged so that the crests and valleys thereof extend substantially vertically except for the distributor sections adjacent the inlet and outlet. An example of such a design may be found in U.S. Pat. No. 3,568,461. In the second type of heat exchanger the principal corrugated fin packing for the two-phase flow passageway is arranged so that the crests and valleys extend substantially horizontally except for the distributor sections adjacent the inlet and outlet. An example of such a design may be found in U.S. Pat. No. 3,568,462.

Thus, in the first type of heat exchanger the general fluid flow is parallel to the crests and valleys of the corrugated fin packing. The liqud and vapor passing in intimate contact with each other pass the "easy way" through the corrugated fin packing. In the second type of heat exchanger the general fluid flow is normal to the crests and valleys of the corrugated fin packing. Thus the liquid and vapor passing in intimate contact with each other pass the "hard way" through the corrugated fin packing. In the "hard way" design the packing must be porous so that the fluid may pass through the sheet material of the corrugated fins.

Each of these two basic design approaches, I believe, present certain difficulties for which the instant invention is intended to correct. I believe the first mentioned type of heat exchanger is predisposed to pass the liquid too quickly toward the bottom of the passageway thereby resulting in insufficient dwell time for the contacting vapor and liquid. I believe an improved vertical distribution or slower fall of the liquid is required to obtain an efficient mass transfer throughout the heat exchanger passageway to permit a gradual change in composition of the fluids from one end of the passageway to the other. Attempts to obtain better vertical distribution by increasing the velocity of upward vapor flow as by decreasing the fin spacing may result in objectionable liquid carry-over. Liquid carry-over then establishes a limit to the throughput.

With respect to the second mentioned type of heat exchanger, I have discovered that for the pores within the porous fin packing to be sufficiently small to adquately uphold the liquid portion for increasing the dwell time by obtaining a wide vertical distribution of liquid, the passageway is severely limited in liquid throughput. Some designs have attempted to solve this problem by using substantially larger pores located to form liquid holding pockets throughout the passageway. An example of this construction will be seen in U.S. Pat. No. 3,512,262.

Furthermore, attempts have been made to combine the two aforementioned designs in an effort to maintain more uniform horizontal distribution of gas and liquid across the width of the two-phase passageway by the use of a liquid redistributor. Such a design is shown in U.S. Pat. No. 3,612,494.

In all the aforementioned constructions, the liquid may tend to move both upward by force of the vapor flow and downward by force of gravity. There is a need for a net downward movement of the liquid because the liquid is introduced to the passageway near the top and removed near the bottom. In these prior art designs, this net downward movement of liquid is in counterflow relationship with the vapor passing upwardly. For the liquid and vapor to pass each other in this manner, a larger passageway is required than had the liquid and vapor been in separate channels. I believe this net downward flow of liquid within the interstices of the fin packing in counterflow relationship to the upward vapor flow is thus sufficient to substantially reduce the potential throughput capacity. This is because the liquid within the interstices of the fin packing tends to become entrained with and carried along with the vapor and because a larger passageway is required.

It will thus be seen that prior art designs may have encountered numerous problems including: insufficient liquid dwell time, non-uniform horizontal distribution of liquid and vapor, inadequate liquid vapor contact, liquid carryover, insufficient vertical spread of liquid, and restrictive throughput capacity.

SUMMARY OF THE INVENTION

To alleviate the aforementioned problems the instant invention provides a liquid flow director means for directing the liquid in a descending flow path that repeatedly horizontally crosses an upwardly flowing gaseous stream. In this way the dwell time for the liquid is increased without dependence upon the principal fin packing as a liquid suspending media. Each of the horizontal liquid passes through the gaseous stream places the liquid into intimate contact with the gas flowing upwardly within the plate-type heat exchanger passageway. Thus, the liquid path functions to progressively distribute the liquid fraction at several different levels of the heat exchanger. The corrugated fin packing above each horizontal pass function as extended heat transfer surface. However, since this fin packing is not relyed upon to produce vapor-liquid contact, its spacing can be wide so that the fin packing functions as a demister to eliminate carryover thereby permitting higher throughput. In this manner the flow rates of gas and liquid within the heat exchanger passage become less critical so that the plate-type heat exchanger mass transfer device may be applied to processes wherein a wider range of flow rates may be encountered. Further, the throughput may be increased without objectionable liquid carryover by decreasing the fin density or spacing which may still remain sufficiently high to accomplish the desired heat transfer function.

It is thus an object of this invention to improve the operating efficiencies of plate-type heat exchangers employed as nonadaibatic fractionating devices.

It is a prime object of this invention to provide a high throughput plate-type heat exchanger for nonadiabatic rectification having corrugated fin packing.

It is another prime object of this invention to provide a nonadaibatic mass transfer heat exchange apparatus which is particularly suited for process applications involving a wider range of flow rates for operating fluids.

It is still another object of this invention to provide a nonadiabatic mass transfer plate-type heat exchanger apparatus of simple and low cost construction.

These and other objects of the invention will become more apparent as this specification describes the invention with reference to the drawings in which.

DETAILED DESCRIPTION

Figures 1, 2, 3, 4, 5, 6, 7, 8, 9:
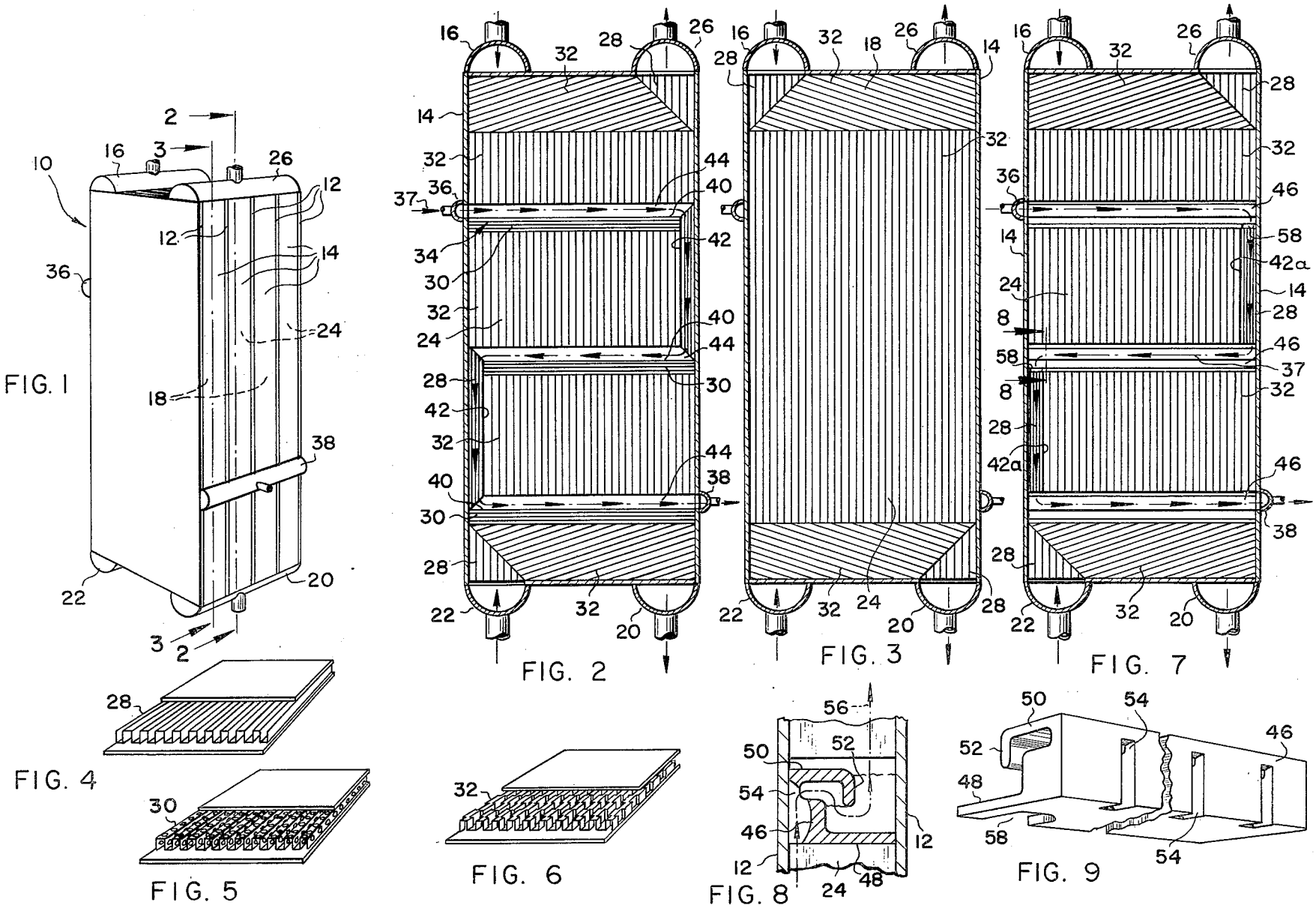
FIG. 1 is a perspective of a plate-type exchanger employing the concepts of my invention.
FIG. 2 is a section taken as indicated in FIG. 1 at line 2—2 showing the internal structure of one of the fluid conducting layers or passageways in which mass transfer takes place.
FIG. 3 is a section taken at line 3—3 of FIG. 1 through another fluid conducting layer or passageway in heat exchange relationship with the passageway shown in FIG. 2.
FIGS. 4, 5 and 6 illustrate different types of corrugated fin packing disposed within the fluid layers of the heat exchanger of FIG. 1.
FIG. 7 is similar to FIG. 2 showing a modified form of liquid distributor.
FIG. 8 is an enlarged section taken at line 8—8 of FIG. 7 showing a cross-section of the modified liquid distributor.
FIG. 9 is an enlarged perspective of the liquid distributor shown in FIGS. 7 and 8.

Now with reference to FIGS. 1 through 6, heat exchanger 10 is comprised of a plurality of elongated vertically extending sheet-like metallic plates 12 of generally similar rectangular configuration disposed in side-by-side, spaced, face-to-face, parallel relationship. Plates 12 are preferably constructed of aluminum for reasons of its high thermal conductivity. If desired, the outer plates of the heat exchanger may be substantially thicker to accommodate the internal pressures of the heat exchanger core.

A metallic sealing means 14, sealingly connects adjacent plates along the margins to define a vertical passageway between each pair of adjacent plates. The metallic sealing means 14 preferably comprises a plurality of elongated metallic bars arranged in end-to-end abutting relationship along the margins of the plates 12. The longitudinal edges of the bars are preferably brazed bonded to the plates 12. Gaps are provided between the bars at the location of headers for ingress or egress of heat exchange fluids to the fluid passageways.

Inlet header 16 is provided for distribution of a first heat exchange fluid to passageways 18. The first heat exchange fluid is discharged from passageways 18 through an outlet heater 20.

A second inlet header 22 is provided to conduct a second gaseous heat exchange fluid to passageways 24. Outlet header 26 is arranged to conduct heat exchange fluid from passageways 24.

Each of passageways 18 and 24 contains a corrugated fin packing which may be constructed by corrugating a thin metallic sheet.

Three types of corrugated fin packing are illustrated in FIGS. 4–6. In each of these figures the fin packing is illustrated as sandwiched between a pair of metallic plates which would correspond to the plates 12 of the heat exchanger. The corrugated fin packing shown in FIG. 4 is simply a corrugated nonimpervious metallic sheet 28. The fin packing illustrated in FIG. 5 is a perforated sheet which has been subsequently corrugated to form a porous fin packing 30. FIG. 6 shows a serrated fin packing 32 formed by corrugating an impervious metallic sheet and simultaneously offsetting the corrugations in opposite directions at uniform intervals thereby providing slits or openings that extend substantially from one side of the fin packing to the other. The various fin packings shown in FIGS. 4, 5 and 6 are well-known to the art and may be cut into slabs of various configurations; i.e., triangular, rectangular and so forth.

In FIGS. 2, 3 and 7, the slabs of fin packing have not been illustrated in detail but the parallel lines thereof are intended to indicate the direction of the crests and valleys of the corrugations thereof. Fin packing sections designated by the numeral 28 are constructed of a nonporous fin packing similar to that illustrated in FIG. 4. Fin packing sections designated by the numeral 30 are constructed of porous fin packing material similar to that illustrated in FIG. 5. Fin packing sections designated by the numeral 32 are constructed of a serrated and thus porous fin material similar to that illustrated in FIG. 6. It will be appreciated that the degree of porosity, the thickness of the slabs, length of the fins, the thickness of the sheet and so forth may vary from one application to another. However, the downcomer sections 42 and **42*a* hereafter mentioned are constructed of nonporous fin material or otherwise provided with a barrier at the side to prevent horizontal flow to or from adjacent fin packing sections. In each case the opposite faces of the slabs or sections of corrugated fin material are brazed bonded to the confining plates 12.**

Now referring particularly to FIG. 2 there is provided a liquid flow director means 34 for directing a liquid from liquid inlet header 36 in a serpentine flow path as illustrated by arrow 37 through passageway 24 to outlet header 38. The liquid flow path 37 has several horizontal legs 40 which traverse the gaseous flow path of passageway 24 extending from the inlet adjacent header 22 to the outlet adjacent header 26. The horizontal leg portions are connected via downcomers 42. Downcomers 42 are preferably constucted of a narrow slab of nonporous corrugated fin material of the type shown at 28 of FIG. 4. If desired, the upper and lower ends may be beveled as illustrated. The downcomer passageways are thus isolated from the remainder of the passageway 24 except at top and bottom.

The horizontal leg portions are constructed of an elongated horizontally extending slab of porous corrugated fin material as illustrated at 30 of FIG. 5. Above this section of fin material is provided a space for liquid to move horizontally across the passageway 24. The pores of this fin material 30 allow the gaseous fluid passing within passageway 24 to pass therethrough and upwardly through the liquid within spaces 44 thereby bringing the liquid passing along path 37 repeatedly into intimate contact with the gas flowing upwardly within passage 24. The gas will normally flow upward through the horizontal legs 40 rather than through the liquid downcomer because of the relative heights of the liquid heads in the horizontal leg 40 and downcomer 42.

In the embodiment illustrated in FIGS. 7 through 9 the horizontal leg of the liquid flow path is provided with a bar extrusion 46 which may extend from the sealing means 14 on each side of the passageway 24. The bar extrusion 46 has a lower horizontal flange 48 which extends from one plate 12 to another plate 12 on opposite sides of the passageway 24. The bar extrusion 46 has a second upper horizontally extending flange 50 extending from one of the plates 12 of passage 24 toward but spaced from the other plate 12 of passage 24. The distal edge of flange 50 has a depending lip 52. Slots 54 have been milled into the bar extrusion 46 at horizontally spaced intervals to provide a tortuous flow path illustrated by arrow 56 in FIG. 8 for passage of gas upwardly therethrough. It will be noted that this construction forms a liquid trap. Flange 48 forms a trough along which liquid in the trap may flow horizontally across the heat exchanger passageway 24 from an inlet header 36 or downcomer 42*a* to the opposite side of the passageway to a downcomer 42*a* or outlet header 38. Where the flow is to a downcomer, the lower flange 48 may be appropriately notched as at 58 to provide the necessary communication with the downcomer 42*a*.

In each of the embodiments illustrated the various elements may be assembled in an appropriate jig. Furthermore, portions of the elements may be clad with an appropriate brazing material so that upon heating the assembly of elements in a high temperature bath or furnace, the elements are brazed bonded into a single unitary or integrated body. The heat exchanger then may be incorporated into process apparatus by appropriate connection to the headers herein shown. When installed in process apparatus heat is conducted through plates 12 disposed between passageways 18 and 24. The corrugated fin packing within these passageways presents extended heat transfer surface and conducts the heat between the fluid passing within the passageways and the adjacent plates 12. Moreover, the brazed bond of the fin packing to the plates 12 provides a heat exchanger core capable of withstanding high internal pressures. Within this heat exchanger core there is provided means for repeatedly passing a liquid crosswise through one of the sets of passages for intimate contact with the gaseous heat exchange fluid passing therein for improved distribution and redistribution of the liquid phase at successively different levels.

It will be further seen that the invention recognizes certain limitations to corrugated fin structure as a means to obtain adequate vertical redistribution of liquid. It takes advantage of the corrugated fin material as a demister means to permit higher throughput through a more open structure such as by more widely spaced corrugations which without the herein described vertical redistribution means would substantially reduce mass transfer efficiencies.

Having thus described in detail two preferred embodiments of my invention, it is recognized that many variations may be made without departing from the scope or spirit of my invention and I accordingly desire to be limited only by the claims.

What is claimed is:

1. A plate-type heat exchanger comprising: a plurality of elongated vertically extending sheet-like metallic plates of generally similar configuration in side-by-side, spaced, face-to-face parallel relationship; metallic sealing means for sealingly connecting adjacent plates along their margins whereby a vertical passageway is defined between each pair of said adjacent plates, certain first passageways for a first heat exchange fluid being interleaved with other second passageways for a second gaseous heat exchange fluid for heat transfer therebetween by heat conduction through said plates; each of said first and second passageways containing a metallic corrugated fin packing braze bonded on opposite sides to and extending between the faces of said adjacent plates whereby said adjacent plates are structurally connected by said fin packing and whereby said fin packing conducts heat between said passageways and said plates; flow director means associated with each of said second passageways for directing a liquid in a descending serpentine flow path having a plurality of substantially horizontal legs disposed at progressively descending levels and each crossing horizontally at least a portion of said associated second passageway; said horizontal legs of said serpentine flow path being in substantially open fluid communication with said associated second passageway; said horizontal legs being in fluid communication with each other by downcomers and at least one of said horizontal legs being in fluid communication at one end to a substantially horizontal leg above and at the other end to a substantially horizontal leg below said one leg by said downcomers whereby liquid passing in said serpentine flow path may traverse said associated second passageway several times to become in part contacted with the gas flowing in said associated second passageway and that liquid flowing in said second associated passageway in a direction opposite to the gas flow therein may be removed by passing into said serpentine flow path at one elevation and recontacted with the gas flowing in said second associated passageway at a lower elevation to thereby establish a stable reflux of the fluids within said second associated passageway.

2. The apparatus as defined by claim 1 wherein said downcomers are disposed within the confines of said metallic sealing means.

3. The apparatus as defined by claim 1 wherein said downcomers are alternately on opposite sides of said second passageway.

4. The apparatus as defined by claim 1 wherein said flow director means defining said horizontal legs includes a bar extending horizontally across said second passageway and having a shape to define a liquid trap.

5. The apparatus as defined by claim 4 wherein said bar includes a downwardly extending lip and a plurality of slots spaced horizontally along said bar and which extend from the lower side of said bar to an elevation above the lower edge of said lip thereby forming said liquid trap.

6. The apparatus as defined by claim 5 wherein said bar is an extruded member.

7. The apparatus as defined by claim 1 wherein said flow director means defining said horizontal legs includes a slab of corrugated fin packing having the crests and valleys thereof extending horizontally.

8. The apparatus as defined by claim 7 wherein said slab of fin packing is a corrugated porous sheet.

9. The apparatus as defined by claim 1 wherein said downcomers include a slab of corrugated fin packing having the crests and valleys thereof extending vertically.

10. The apparatus as defined by claim 9 wherein said slab of fin packing is a corrugated nonporous sheet.

11. The apparatus as defined by claim 1 wherein said corrugated fin packing has its crests and valleys extending vertically throughout a major portion of the vertical length of said second passageway.

12. The apparatus as defined by claim 1 wherein said downcomers are closed from fluid communication with said second passageway except at their upper and lower ends.

* * * * *